US006805268B2

(12) United States Patent
Cartabbia

(10) Patent No.: US 6,805,268 B2
(45) **Date of Patent: *Oct. 19, 2004**

(54) IRONING DEVICE FOR APPLICATION TO MACHINES FOR IRONING TROUSERS BY BLOWING HOT AIR THERETHROUGH

(76) Inventor: Giovanni Cartabbia, Via Piantada, 9/D, 25036 Palazzolo sull'Oglio (IT)

( * ) Notice: Subject to any disclaimer, the term of this patent is extended or adjusted under 35 U.S.C. 154(b) by 7 days.

This patent is subject to a terminal disclaimer.

(21) Appl. No.: 10/079,100

(22) Filed: Feb. 19, 2002

(65) Prior Publication Data

US 2002/0130147 A1 Sep. 19, 2002

(30) Foreign Application Priority Data

Mar. 13, 2001 (IT) ..... MI2001A0534

(51) Int. Cl.[7] ..... D06C 15/00
(52) U.S. Cl. ..... 223/57; 223/73; 38/7
(58) Field of Search ..... 223/57, 72, 73; 38/14, 6, 57, DIG. 1, DIG. 2, 7

(56) References Cited

U.S. PATENT DOCUMENTS 6,446,369 B2 * 9/2002 Cartabbia ..... 38/7

* cited by examiner

*Primary Examiner*—John J. Calvert
*Assistant Examiner*—James G Smith
(74) *Attorney, Agent, or Firm*—Hedman & Costigan, P.C.

(57) ABSTRACT

An ironing device, to be used in ironing machines for ironing trousers by blowing hot air therethrough, comprises a driving construction, supporting a pair of carriages, each of which supports, in turn, at least an ironing block for ironing the trousers pockets, said driving construction being designed for bringing said carriages from an opened position, in which the trousers article is arranged on a tool for tensioning the pelvis region of the trousers article, and a pressing position, in which the pocket ironing blocks press the trousers pockets in the ironing block arranged inside the pelvis region of the pelvis region tensioning tool.

6 Claims, 11 Drawing Sheets

IRONING DEVICE FOR APPLICATION TO MACHINES FOR IRONING TROUSERS BY BLOWING HOT AIR THERETHROUGH

BACKGROUND OF THE INVENTION

The present invention relates to a ironing device for application to machines for ironing fold-free sports trousers by blowing hot air therethrough.

As is known, for automatically ironing fold-free sports trousers, are conventionally used ironing machines comprising an ironing block provided to be arranged inside the trousers pelvis region which, as it is broadened, supports the trousers at the pelvis region thereof, and a gripper assembly including a plurality of grippers designed for gripping the bottom portions of the trousers legs for tensioning the trousers article.

A device for blowing hot air performs the ironing operation, by blowing heated air through the inside of the trousers article.

In automatically ironing the above mentioned sports trousers, however, a problem frequently occurring is that the trousers pockets cannot be efficiently ironed by blowing heated air through the inside of the trousers article, since the mentioned pockets are of an inserted type.

SUMMARY OF THE INVENTION

Accordingly, the aim of the present invention is to provide such an ironing device, designed for application to an ironing machine for ironing trousers by blowing hot air therethrough, which is also adapted to efficiently iron the front and/or rear pockets of sports trousers.

Within the scope of the above mentioned aim, a main object of the present invention is to provide such an ironing device which can be applied to any desired automatic ironing machine, either controlled or not by an operator for locating the trousers article to be ironed.

Yet another object of the present invention id to provide such an ironing device which can also be applied to already existing ironing machine for ironing trousers and the like.

According to one aspect of the present invention, the above mentioned aim and objects, which will become more apparent hereinafter, are achieved by an ironing device, to be applied to ironing machines for ironing trousers, by blowing hot air therethrough, said ironing device being characterized in that it comprises a driving construction supporting a pair of carriages, each of which supports in turn at least an ironing block for ironing the pockets of the trousers.

The driving construction, in particular, is designed to bring the carriages from an open position, in which the trousers article is arranged on a tool for tensioning the pelvis region of the trousers article, to a pressing position, in which said trousers article pocket ironing blocks press the trousers article pockets on the inner ironing blocks for ironing the trousers article pelvis region of said trousers article pelvis region tensioning tool.

BRIEF DESCRIPTION OF THE DRAWINGS

Further characteristics and advantages of the present invention will become more apparent hereinafter from the following detailed disclosure of a preferred, though not exclusive, embodiment of the invention, which is illustrated, by way of an indicative, but not limitative example, in the accompanying drawings, where.

DESCRIPTION OF THE PREFERRED EMBODIMENTS

Figure 1:
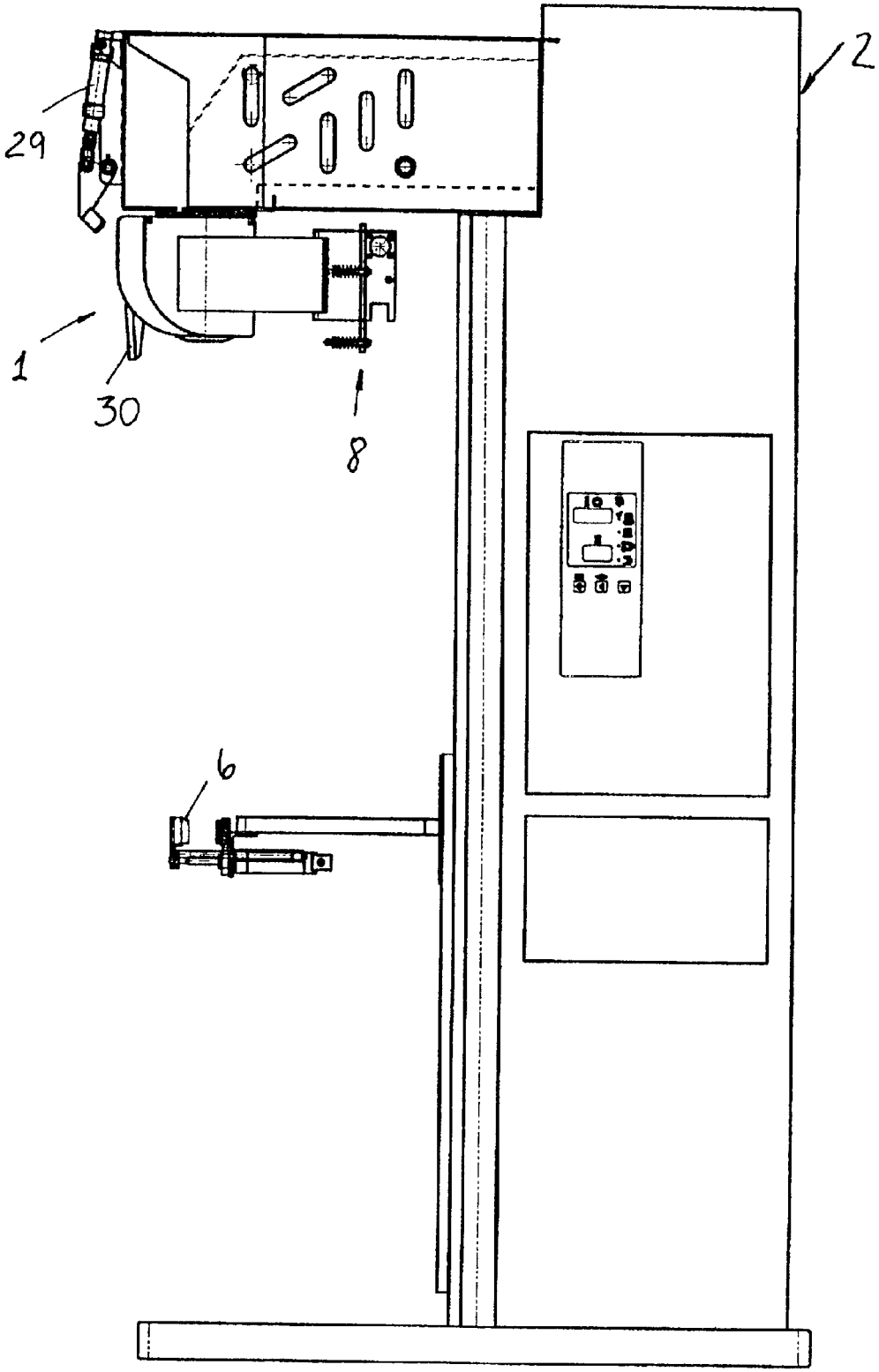
FIG. 1 is a side elevation view of an ironing machine for ironing trousers including an ironing device according to the present invention.
Figure 2:
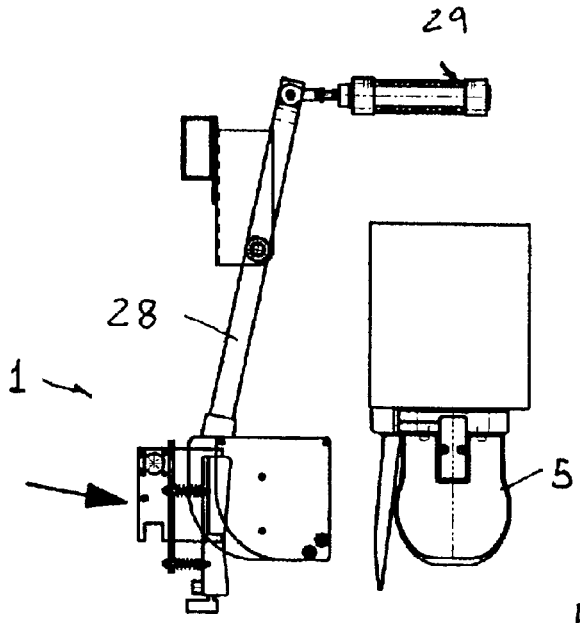
FIG. 2 is a further side elevation view of the ironing device according to the invention, in an embodiment thereof which does not require a controlling operator.
Figure 3:
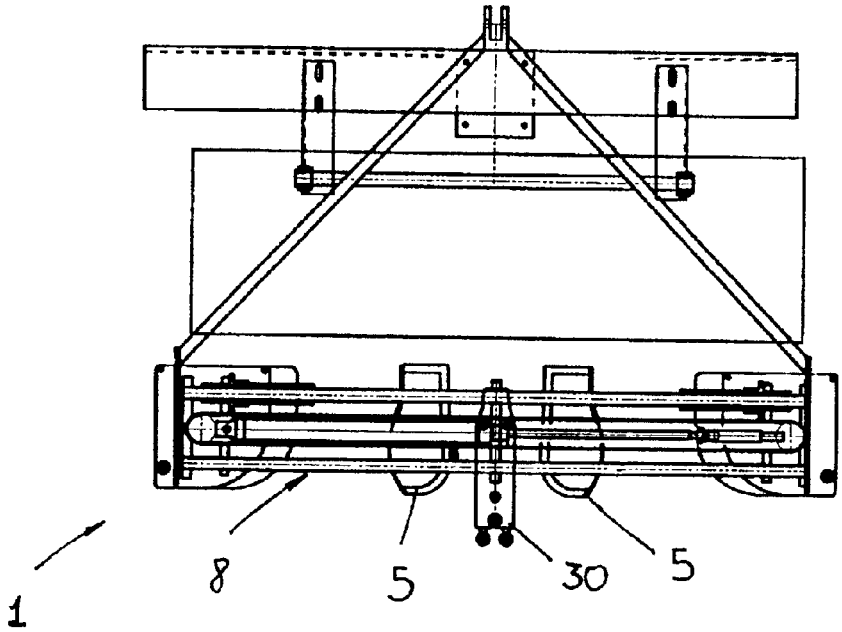
FIG. 3 is a further front elevation view of the ironing device according to the present invention, in an embodiment thereof which does not require a controlling operator.
Figure 4:
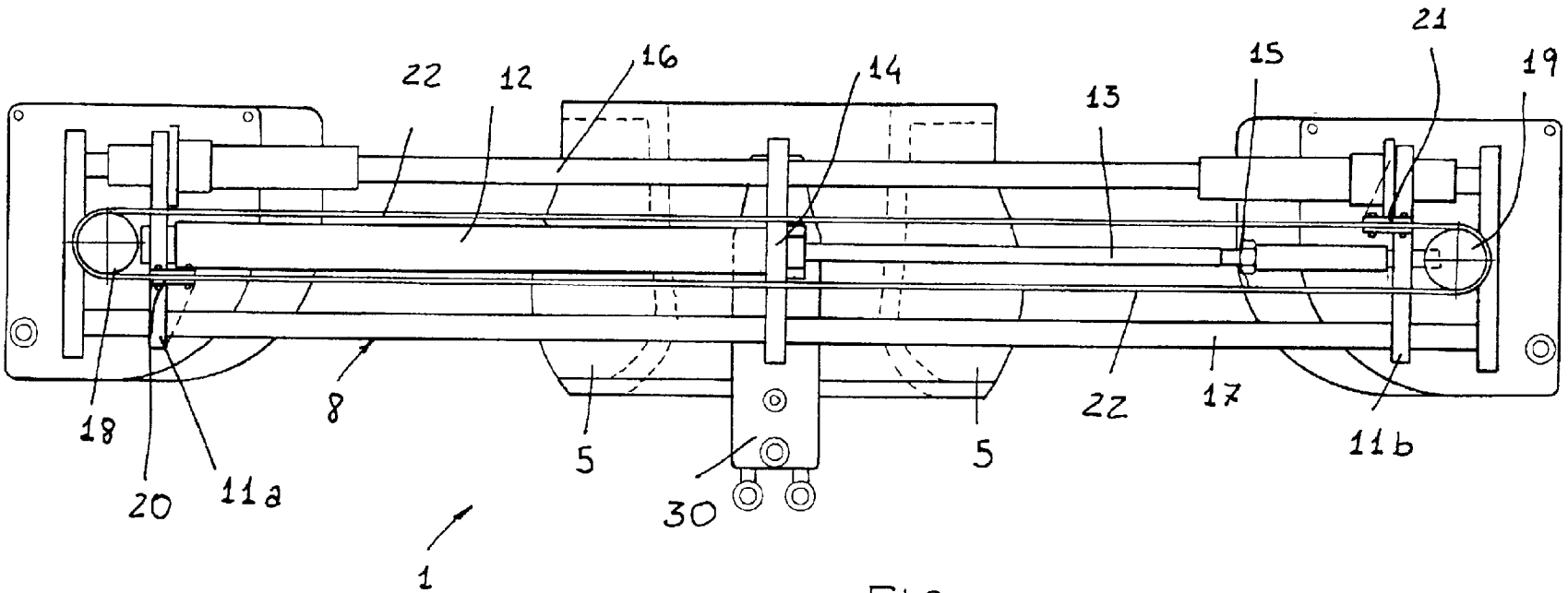
FIG. 4 is a further front elevation view, on an enlarged scale, of the ironing device according to the invention.

With reference to the number references of the above mentioned figures, the ironing device according to the present invention, which has been generally indicated by the reference number 1, has been specifically designed for application to an ironing machine 2 for ironing, by blowing hot therethrough a fold-free trousers 3, said ironing machine comprising as main components thereof, a tool 4 for tensioning the pelvis region of the trousers by specifically contoured ironing blocks 5, and a gripping device 6, designed for gripping the bottom end portions 7 of the trousers.

The ironing device for ironing the front and/or pockets, according to a desired arrangement, comprises a driving construction 8 for driving two slides or carriages 11*a* and 11*b* adapted to support either one or two pairs of ironing blocks for ironing the trousers pockets, which have been respectively indicated by the reference number 23, for the front pocket ironing blocks, and 24, for the rear pocket ironing blocks.

More specifically, the driving construction 8 comprises a pneumatic piston 12, coupled to a central upright 14 and including a piston rod 13 comprising an adjusting device 15 for micro metrically adjusting the length of the piston rod.

The driving construction 8 comprises, moreover, a top guide rod 16 and a bottom guide rod 17, thereon said carriages 11*a*, 11*b* slide, each said carriages including a respective pulley 18 and 19.

Said pulleys 18 and 19 are engaged by a drive belt 22, including two latching plates 20 and 21 making said belt rigid with said carriages 11*a* and 11*b* respectively, thereby, as the pneumatic cylinder coupled to the carriage 11*b* drives the latter, the carriage 11*a* will follow the displacement of said carriage 11*b*, in an opposite direction, owing to the connection provided by the drive belt 22.

On said carriages 11*a* and 11*b* are supported said pocket ironing blocks, respectively indicated by the reference numbers 23, for the front pocket ironing blocks, and 24, for the rear pocket ironing blocks.

Each ironing block 23 and 24 is respectively mounted on its respective carriage 11*a* and 11*b* through a bracket 25 rigid with said carriage and to which the respective ironing block is coupled through a hinge 26 and an abutment resilient element 27.

FIGS. 1–3, 8–14 show the ironing device according to the present invention applied to an automatic ironing machine which can operate without a controlling operator, in which the driving construction 8 is supported by a supporting lever 28 which, being driven by a pneumatic cylinder 29, carries the ironing device 1 to a set ironing position.

Figure 5:
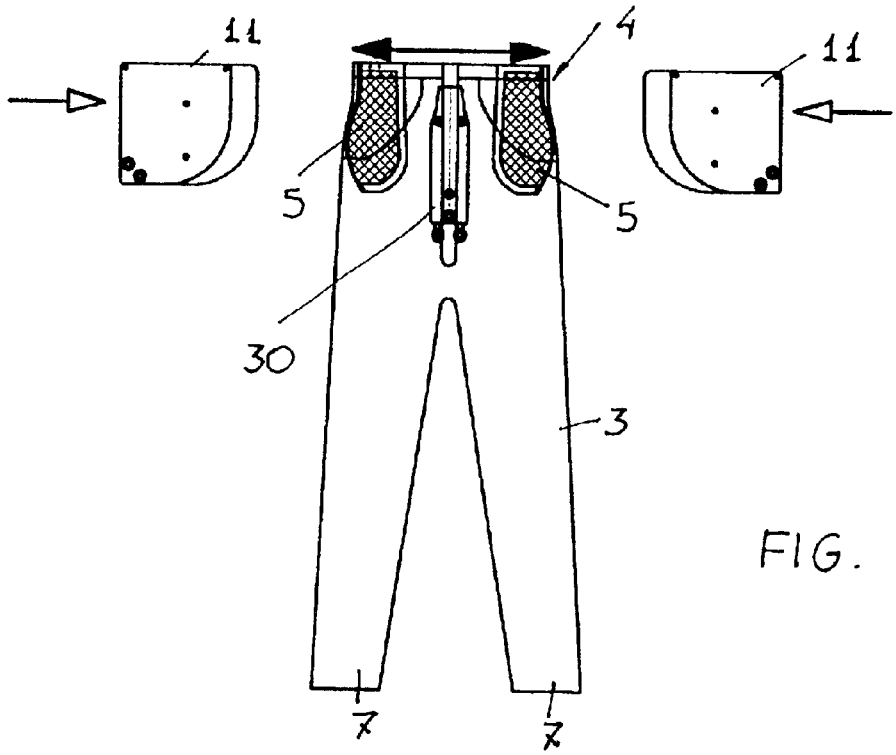
FIG. 5 is a further front elevation view schematically illustrating the operation of the ironing device according to the invention, in an embodiment thereof requiring a controlling operator.
Figure 6:
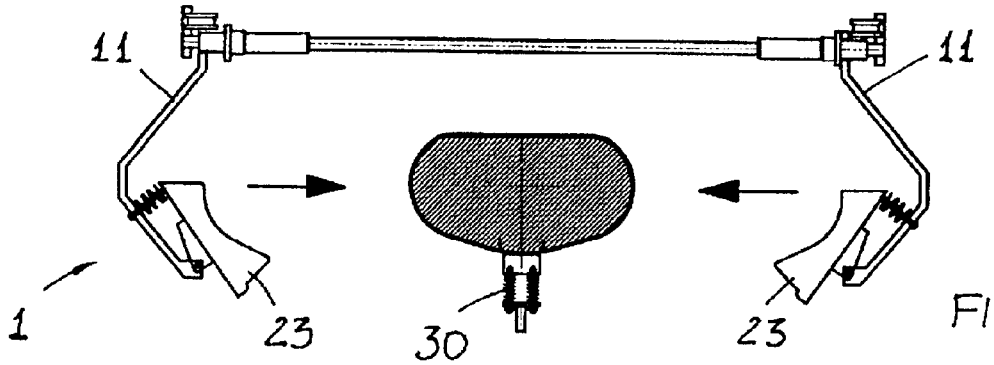
FIG. 6 is a top plan view of the ironing device according to the invention, including two ironing blocks for ironing the trousers article front pockets, in the embodiment thereof controlled by an operator.
Figure 7:
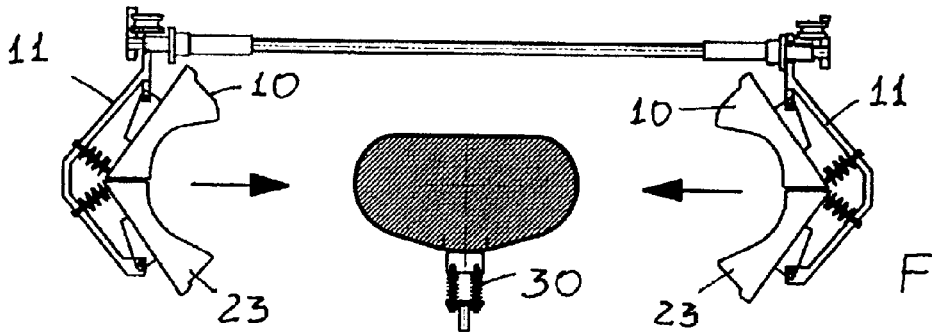
FIG. 7 is a further top plan view of the subject ironing device including two double ironing blocks for ironing the front and rear pockets of the trousers article, in the embodiment thereof controlled by an operator.
Figure 8:
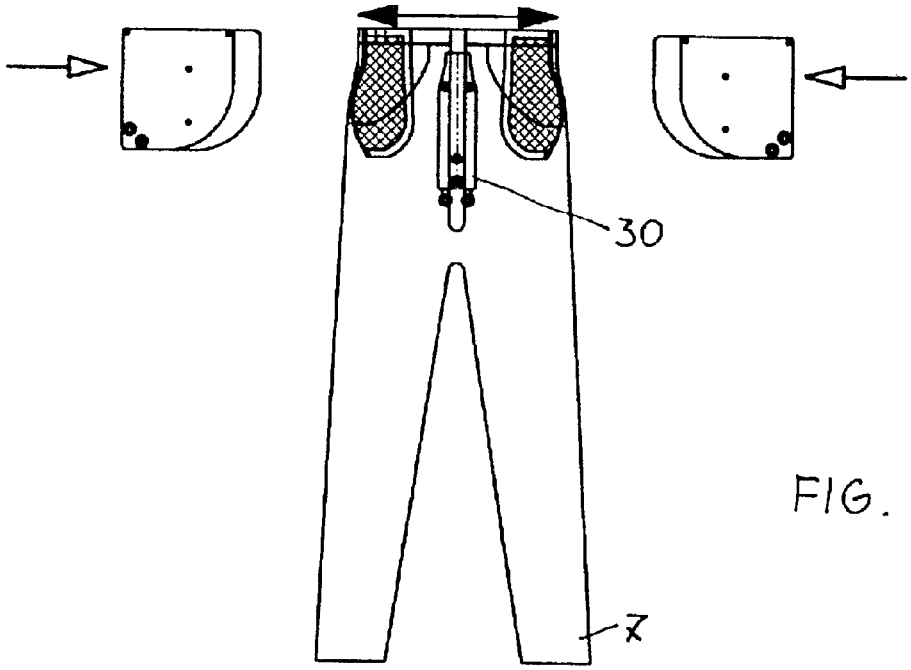
FIG. 8 is a front elevation view schematically illustrating the operation of the ironing device according to the present invention, in the embodiment thereof not controlled by an operator.
Figure 9:
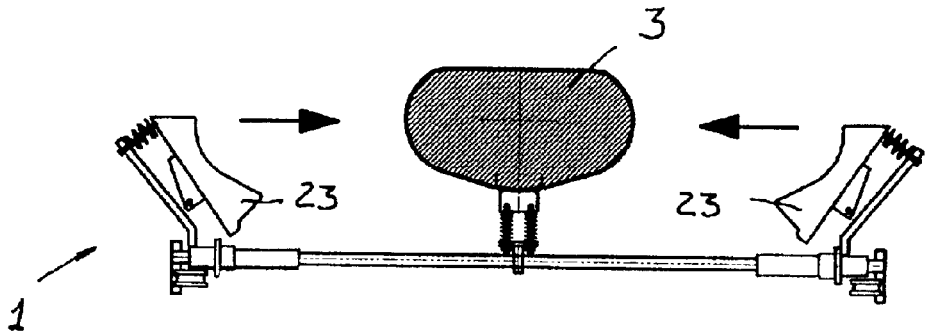
FIG. 9 is a top plan view of the subject ironing device including two ironing blocks for ironing the front pockets of the trousers article, in the embodiment thereof not controlled by an operator.
Figure 10:
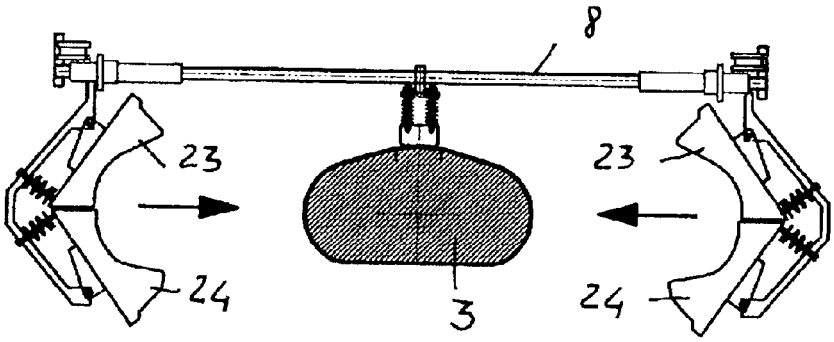
FIG. 10 is a top plan view of the subject ironing device including two double ironing blocks for ironing the front and rear pockets of the trousers article, in the embodiment thereof not controlled by an operator.
Figure 11:
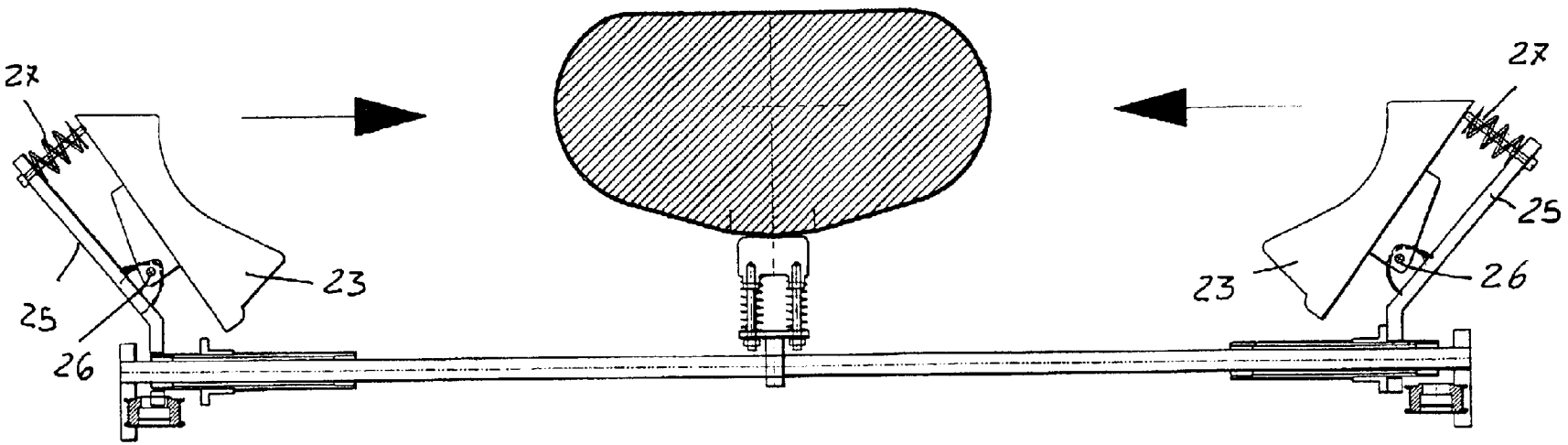
FIG. 11 is a further top plan view, on an enlarged scale, showing the subject ironing device in the embodiment thereof not controlled by an operator and with two ironing blocks for ironing the front pockets of the trousers article.
Figure 12:
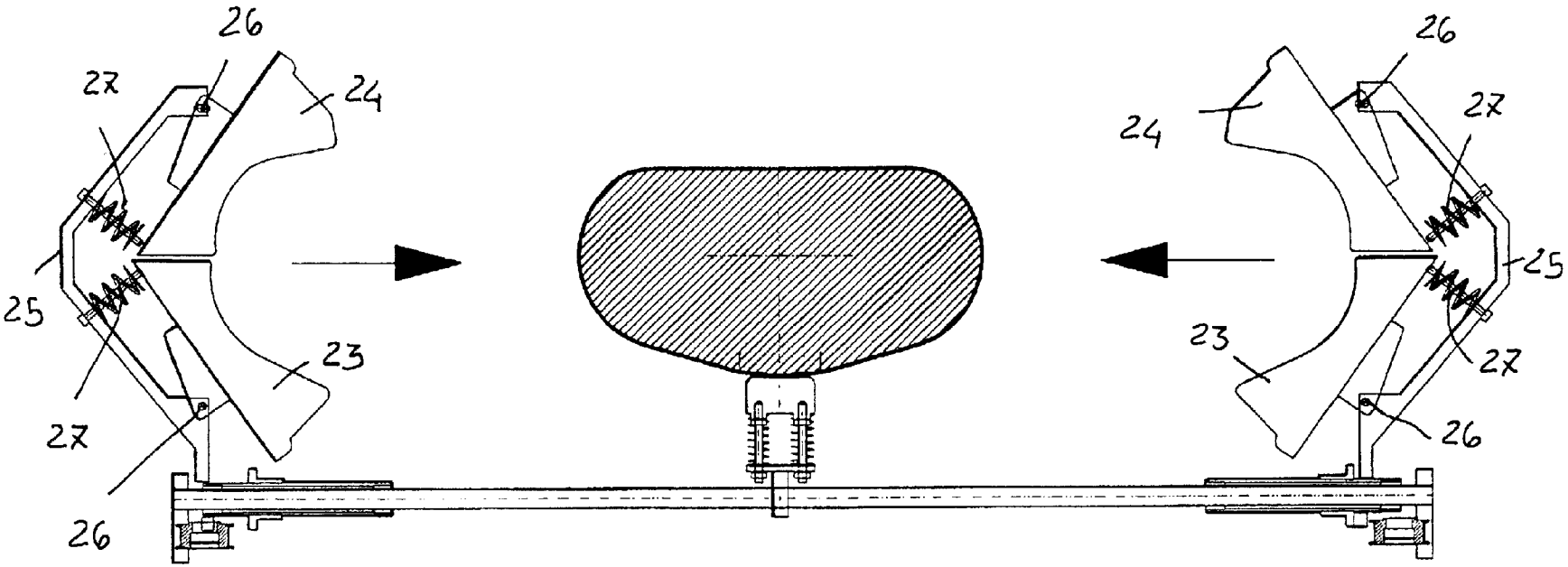
FIG. 12 is a further top plan view, on an enlarged scale, illustrating the subject ironing device, in the embodiment thereof not controlled by an operator and including two pairs of ironing blocks for ironing the front pockets and the rear pockets of the trousers article.
Figure 13:
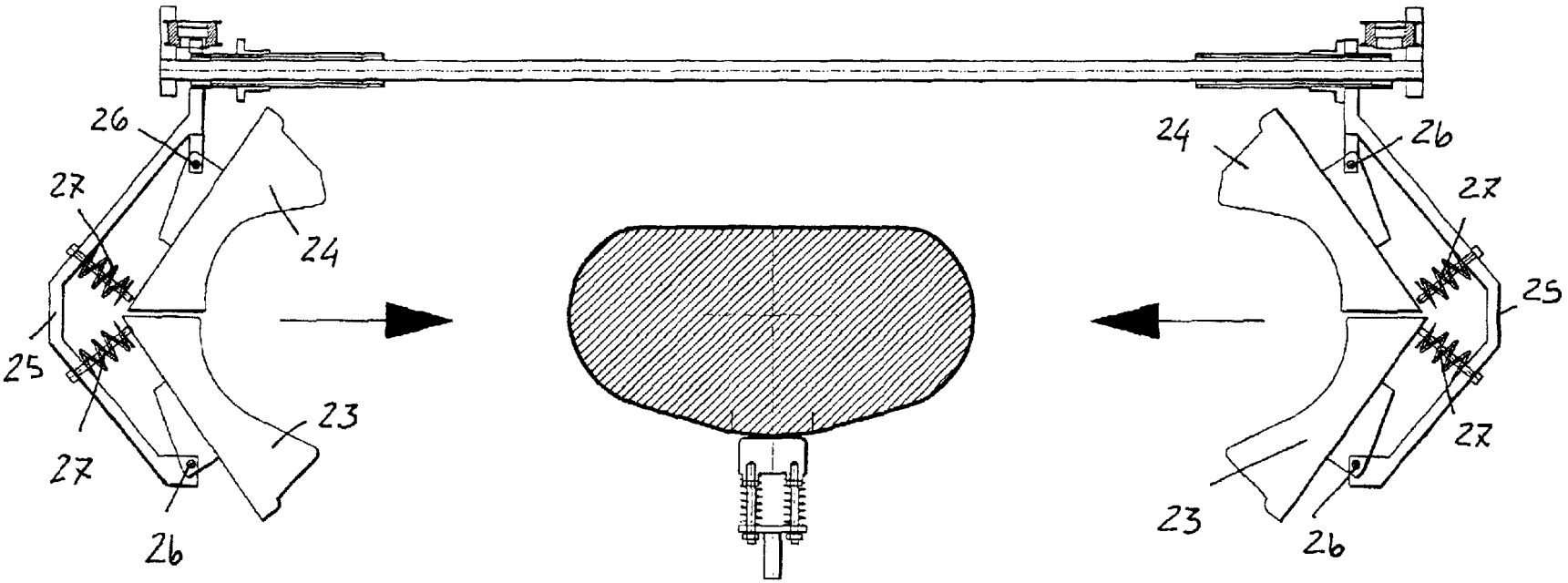
FIG. 13 is a further top plan view, on an enlarged scale, illustrating the subject ironing device in its embodiment controlled by an operator and including two pairs of ironing blocks for ironing the front and rear pockets of the trousers article.
Figure 14:
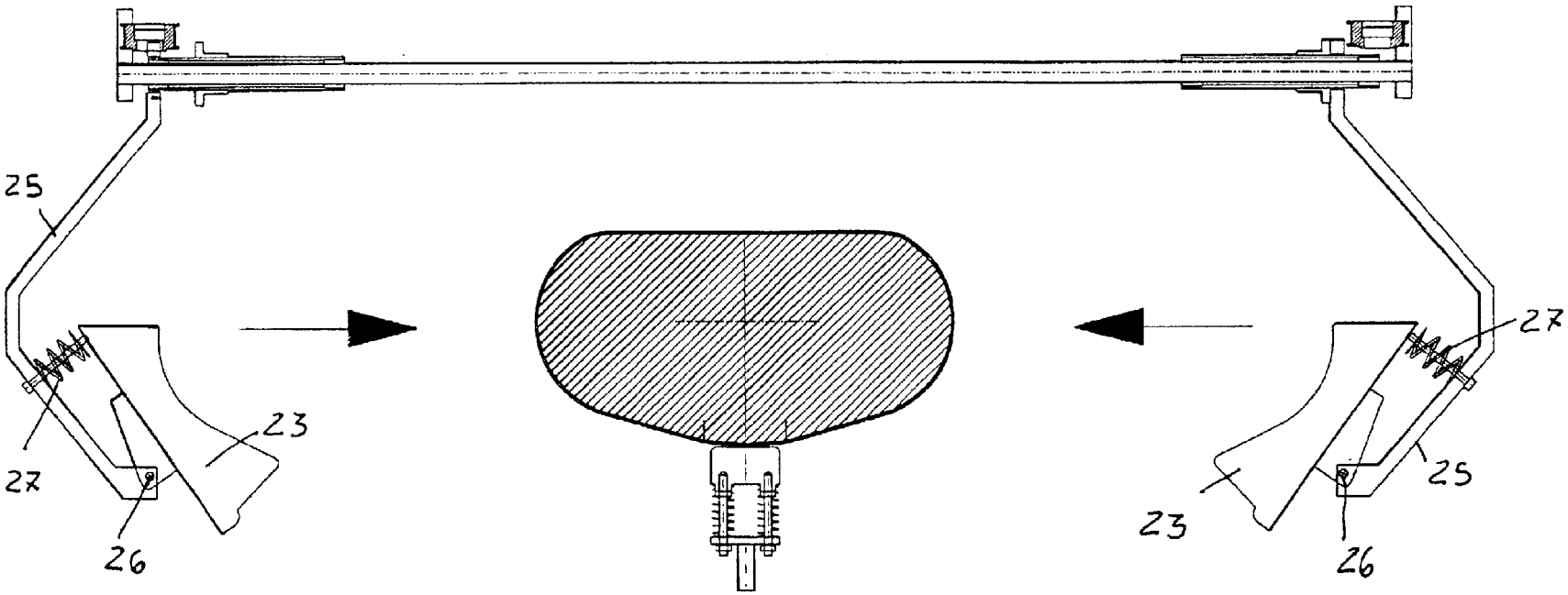
FIG. 14 is a further top plan view, on an enlarged scale, showing the device in its embodiment controlled by an operator and including a pair of ironing blocks for ironing the front pockets of the trousers article.

FIGS. 5–7, in turn, schematically illustrate an ironing machine controlled by a controlling operator, not specifically shown, provided for properly arranging the article to be ironed and for arranging the driving construction 8 at a backward position from the article to be ironed, whereas, at the front, is only provided an ironing block for ironing the flap 30.

In both cases, either with or without an operator, the operation of the ironing device according to the present invention is substantially the same: in fact, as the two carriages are driven by the pneumatic cylinder 12 through the drive belt 22, said carriages will be closed on the trousers article pelvis region, upon causing the tension tool 4 to tension the mentioned pelvis region by the contoured blocks 5 and upon causing the gripping device 6 to grip the bottom end portions 7 of the trousers article.

Figure 15:
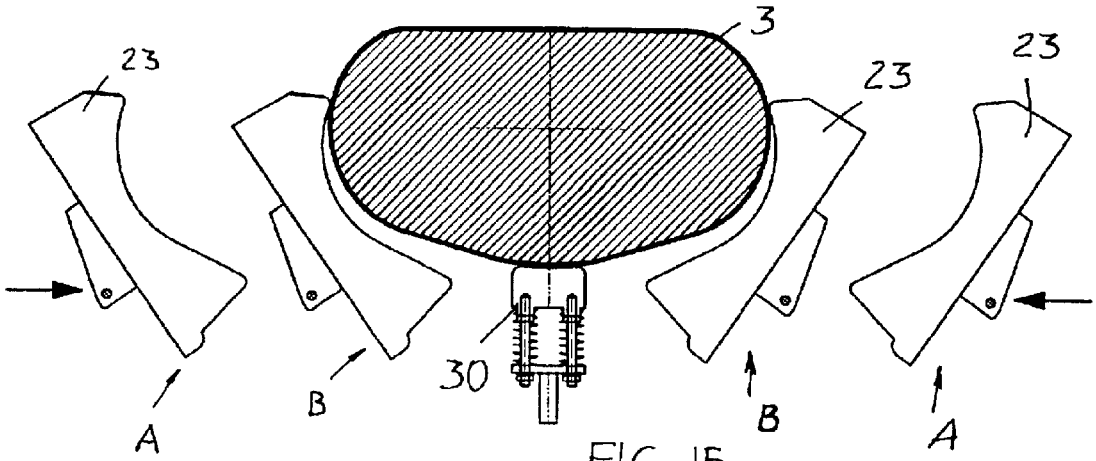
FIGS. 15–17 are further schematic top plan view showing the operating steps of the subject ironing device, in the embodiment thereof including a pair of ironing blocks for ironing the front pockets of the trousers article.
Figure 16:
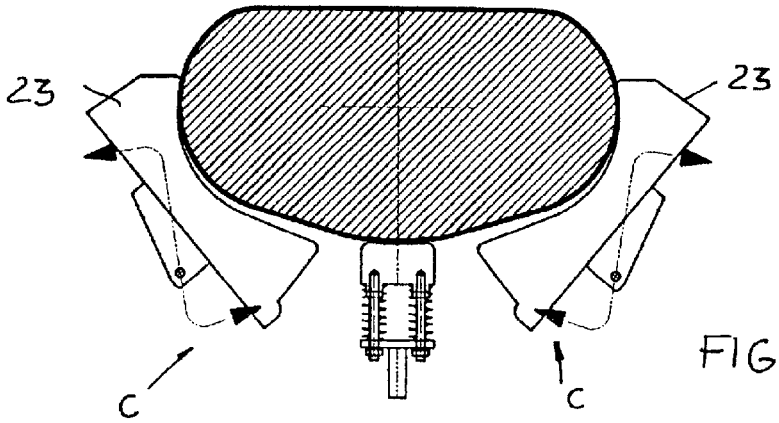
Figure 17:
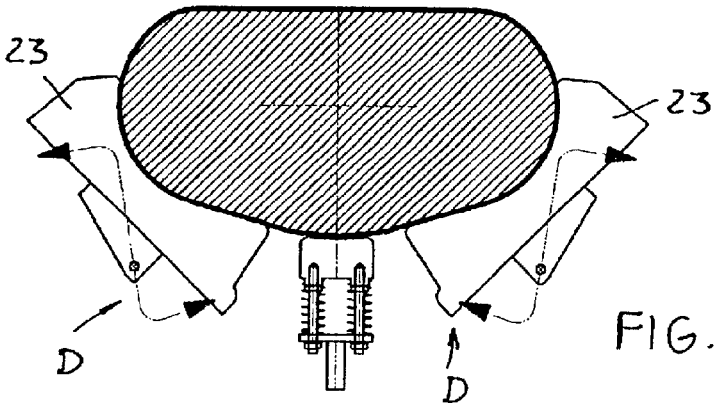
Figure 18:
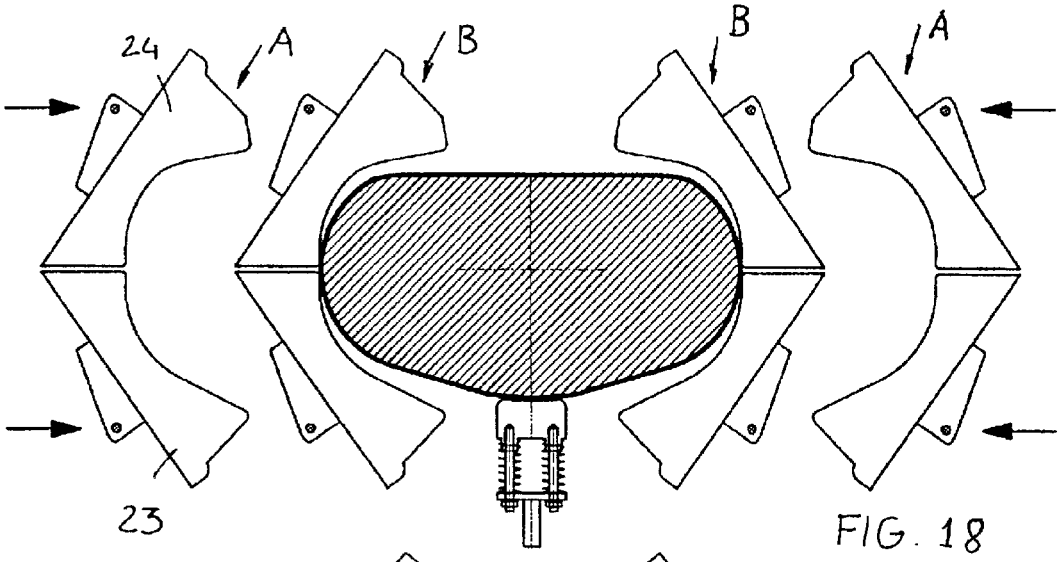
FIGS. 18–20 are further schematic top plan view showing the operating steps of the subject ironing device in its embodiment including two pairs of ironing blocks for ironing the front and rear pockets of the trousers article.
Figure 19:
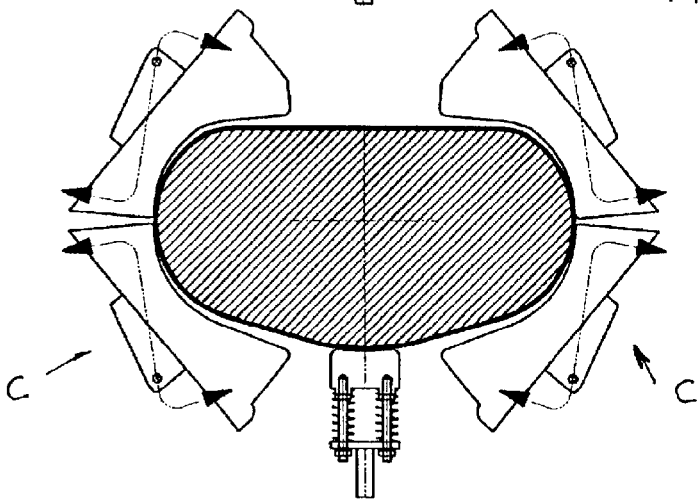
Figure 20:
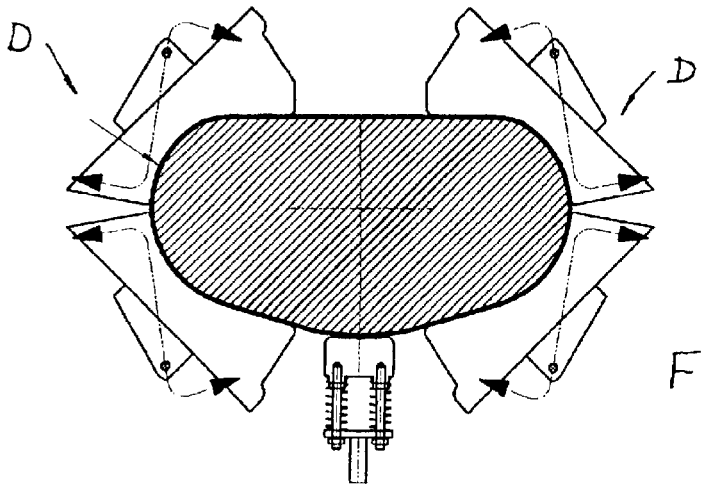

In operation, the front ironing blocks 9, and the optional rear blocks 10, are closed on the pelvis region, according to operating steps shown in FIGS. 15–17, with respect to the ironing blocks for only ironing the front pockets, and FIGS. 18–20 with respect to the ironing blocks for ironing the front and rear pockets.

With reference to FIGS. 15–17, the driving of the front pocket ironing blocks 9 is started from a starting position A in which the resilient abutment element 27 holds the ironing block 23 in a position which is arranged at a broader angle from the contour of the pelvis region.

As the ironing blocks 23 are moved toward the trousers article, they will contact said trousers article (step B).

By overcoming the counterbiassing force of the resilient elements, the ironing blocks will be progressively wound about the trousers article (step C) to achieve a pressing end position, indicated by D in the figures.

The operation of the device including two pairs of pocket ironing blocks, for simultaneously ironing the front and rear pockets, is schematically shown in FIGS. 18–20, and is fully similar to the operation in which a single pair of ironing blocks is used.

It has been found that the invention fully achieves the intended aim and objects.

In practicing the invention, the used materials, as well as the contingent size and shapes, can be any, depending on requirements and the status of the art.

What is claimed is:

1. An ironing device, to be applied to ironing machines for ironing, by blowing hot air therethrough, sports trousers having a trousers pelvis region, trousers legs and trousers pockets, characterized in that said ironing device comprises a driving construction, supporting a pair of supporting carriages, each of which supports at least a pocket ironing block for ironing said pockets of said trousers, said driving construction being adapted to bring said supporting carriages from an open position, in which said trousers are arranged on a tensioning tool for tensioning said pelvis region of said trousers, to a pressing position, in which said pocket ironing blocks press said trousers pockets on further ironing blocks arranged inside said trousers pelvis region of said tensioning tool.

2. An ironing device, according to claim 1, characterized in that each said pocket ironing block is mounted on a respective said supporting carriage through a bracket rigid with said carriage, and to which said pocket ironing block is coupled by a hinge element and a resilient abutment element.

3. An ironing device, according to claim 2, characterized in that each said carriage is adapted to support either one or two said pocket ironing blocks.

4. An ironing device, according to claim 1, characterized in that said driving construction comprises a pneumatic piston for driving said carriages, said pneumatic piston being coupled to a central upright and having a piston rod including an adjusting device for micrometrically adjusting a length of said piston rod.

5. An ironing device, according to claim 1, characterized in that said driving construction comprises a top guide rod and a bottom guide rod, thereon said carriages slide, and including each a pulley, said pulleys being engaged by a drive belt comprising two latching plates making said drive belt rigid with said carriages, thereby as said pneumatic piston, coupled to one of said carriages, drives said carriage, the other carriage follows said first carriage in an opposite direction, as driven by said drive belt.

6. An ironing device, according to claim 1, characterized in that each said carriage supports at least two pocket ironing blocks for ironing said trousers pockets, said at least two pocket ironing blocks being coupled to a bracket and including each a resilient abutment element, thereby simultaneously ironing front and rear pickets of said trousers.

* * * * *